United States Patent [19]

Bruno

[11] 4,178,724

[45] Dec. 18, 1979

[54] RAIL GRINDING SYSTEM

[75] Inventor: Anthony T. Bruno, East Syracuse, N.Y.

[73] Assignee: Harsco Corporation, Camp Hill, Pa.

[21] Appl. No.: 889,289

[22] Filed: Mar. 23, 1978

[51] Int. Cl.[2] ..... B24B 23/00

[52] U.S. Cl. ..... 51/178

[58] Field of Search ..... 51/178, 241 LG, 258

[56] References Cited

U.S. PATENT DOCUMENTS

| | | | |
|---|---|---|---|
| 1,735,693 | 12/1929 | Pitman | 51/178 |
| 2,018,411 | 10/1935 | Miller | 51/178 |
| 2,035,154 | 3/1936 | Faries et al. | 51/178 |
| 2,197,729 | 4/1940 | Miller | 51/178 |
| 2,779,141 | 1/1957 | Speno, Jr. | 51/178 |
| 3,707,808 | 1/1973 | Danko | 51/178 |
| 4,050,196 | 9/1977 | Theurer | 51/178 |
| 4,091,578 | 5/1978 | Panetti | 51/178 |

*Primary Examiner*—Othell M. Simpson
*Assistant Examiner*—Roscoe V. Parker
*Attorney, Agent, or Firm*—Neuman, Williams, Anderson & Olson

[57] ABSTRACT

In a preferred embodiment this improved mobile rail grinding system comprises propulsion and power source means, a plurality of rail grinding cars coupled thereto and a water car. Each rail grinding car comprises a carrier having a support frame for a housing structure upstandingly supported thereon. The housing structure is adjustably movable on the support frame over a predetermined arc generally centered about the center of curvature of the running surface of the track. A motor is telescopically disposed within the housing structure and has a rotatable shaft downwardly disposed toward the track with a grinding wheel concentrically mounted thereon whereby the working surface of the grinding wheel is gravitationally brought into contact with the running surface of the track. A single piston-cylinder assembly, which is aligned with the center of rotation of the motor means and grinding wheel, is disposed so as to control the reciprocal movement of the motor means. By offsetting or counterbalancing a portion of the gravitational forces, it controls the force of the grinding stone against the running surface of the rail. Improved control and protective devices cope with problems peculiar to such systems.

26 Claims, 7 Drawing Figures

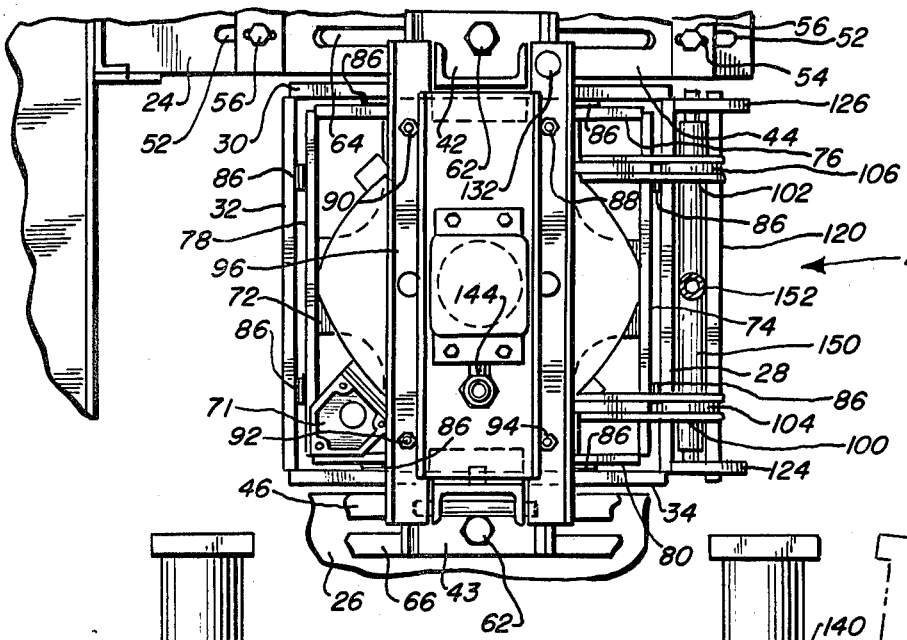
FIG. 3
FIG. 4
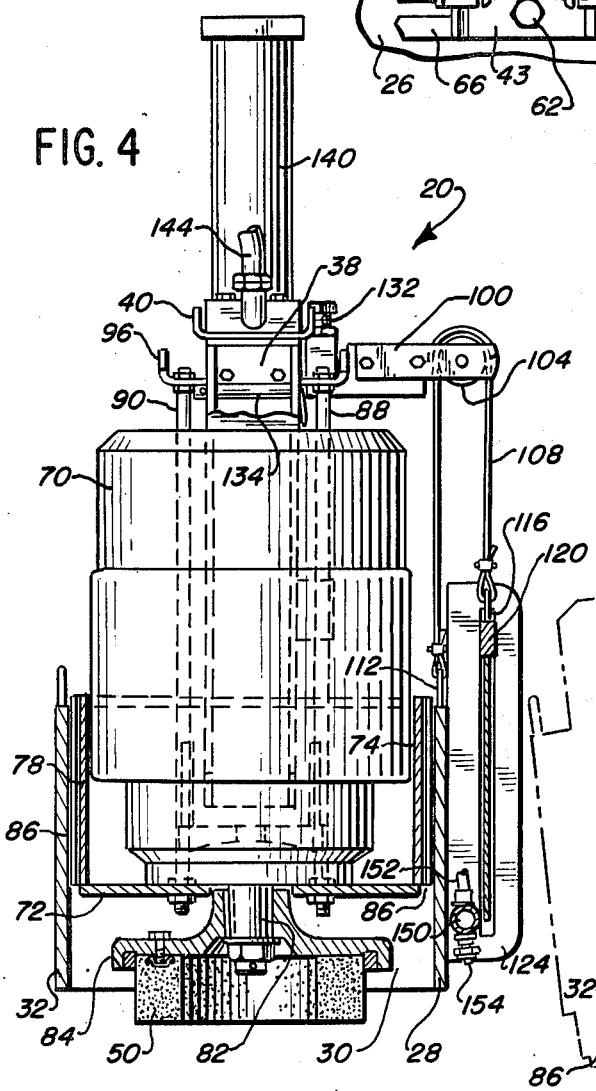
FIG. 5
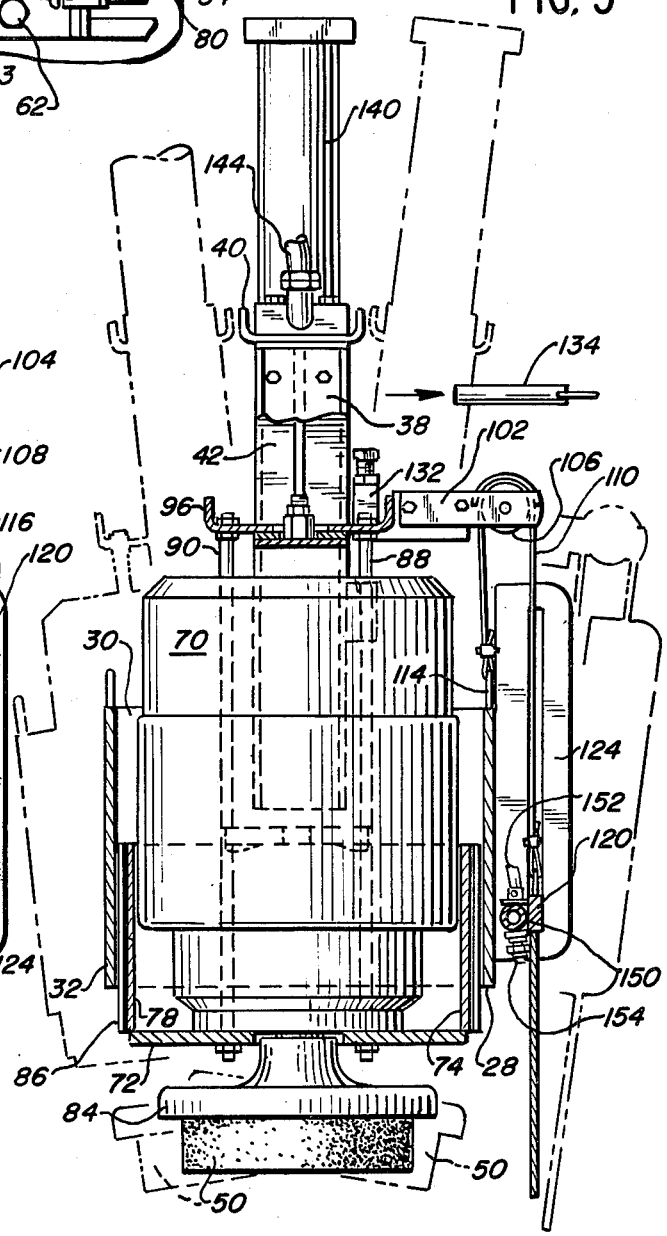

FIG. 6
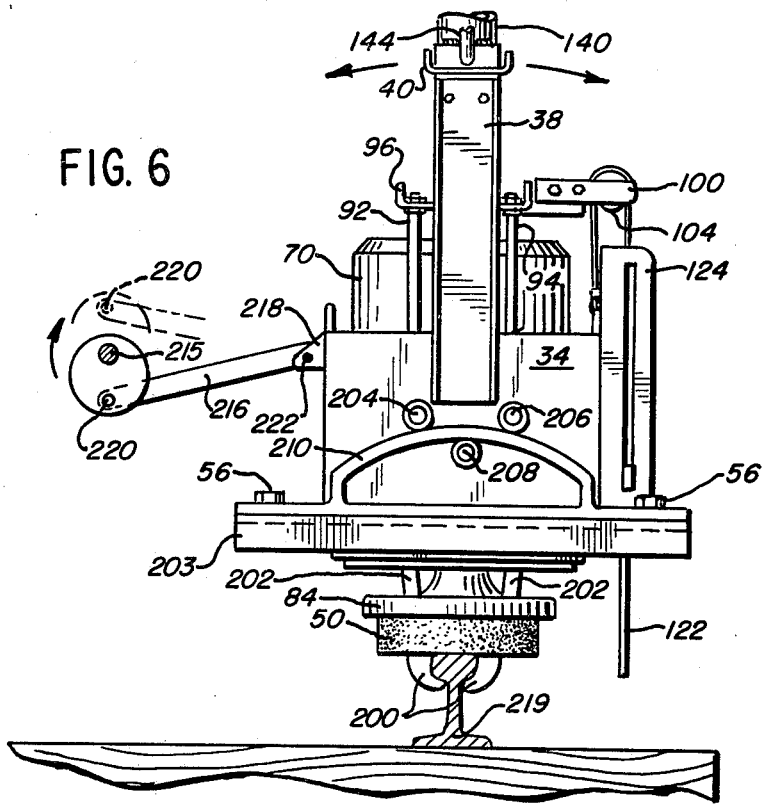
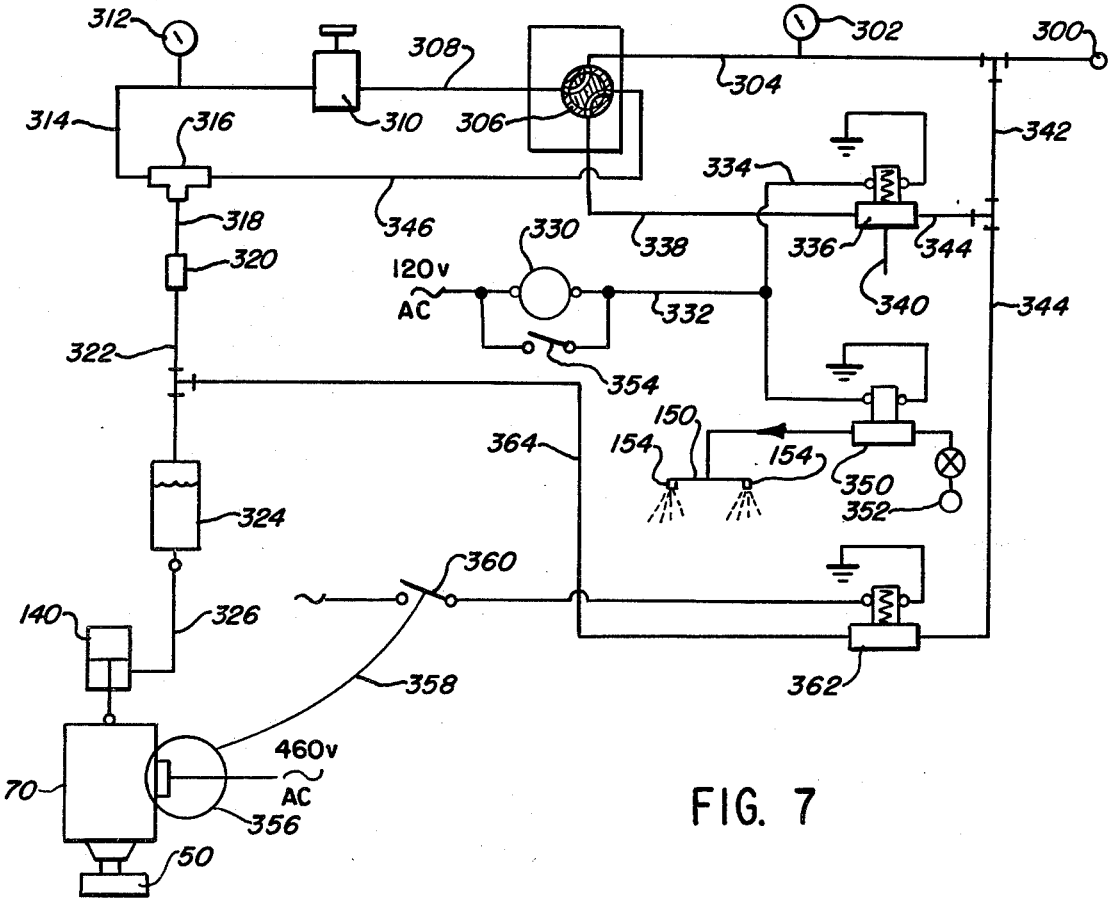
FIG. 7

RAIL GRINDING SYSTEM

BACKGROUND OF THE INVENTION

1. Field of the Invention

This invention relates to improvements in rail grinding systems for grinding the convex running surface of the track, whether the track be new, worn, relaid, bolted-joint or welded. More specifically, it relates to improvements in rail grinding systems which provide enhanced performance, greater versatility, reduced complexity, fewer operating problems and reduced cost.

While the present invention is described herein with reference to particular embodiments, it should be understood that the invention is not limited thereto. The rail grinding system of the present invention may be employed in a variety of forms and may be adapted to cope with a variety of rail grinding requirements, as those skilled in the art will recognize in the light of the present disclosure.

2. Description of the Prior Art

Rail grinding systems of the general type contemplated herein are well known in the prior art and have received extensive commercial acceptance. Representative prior art includes, for example, U.S. Pat. Nos. 2,018,411 to Miller; 2,035,154 to Faries et al.; 2,197,729 to Miller; 2,779,141 to Speno et al.; and 4,050,196 to Theurer. The present invention is directed to improvements in such systems.

Modern day high train speeds and rail loadings have accentuated the need for track rails having smooth running surfaces for reasons of safety, economy, riding comfort, protection of the track, track bed and rolling stock, noise suppression, over-all reduced maintenance costs, and the like. These considerations are well documented, and the importance thereof has been receiving greater appreciation in recent years. These considerations do not apply just to worn track with bolted rails. Even newly-laid track, which sometimes suffer from minor surface irregularities and joint mismatch, and welded track, which sometimes suffer from irregular or abnormal weld heights, benefit greatly from rail grinding operations to approximate as closely as possible the requisite smooth contour all along the running surface and to minimize impact damage and rail batter and related deleterious effects.

Prior-art rail grinding apparatuses, such as disclosed in the aforementioned patents, suffer from one or more shortcomings which limit their usefulness or otherwise render them costly or otherwise problem-prone. For example, in certain apparatuses the grinding stones must be adjusted to a variety of angles to approximate the running surface of the rail. This necessitates that the grinding stones be tilted and also moved laterally for each new grinding position. The dual adjustment requires coordination of the angle of tilt and lateral displacement, is prone to error when making field adjustments, requires considerable effort, is time-consuming and complicates the apparatus.

Problems are also encountered when adjusting the force or pressure exerted by the grinding stone against the rail head. Manifestly, too little pressure may not provide the results desired and slows down the operation, thereby reducing rail grinding efficiency. Too much pressure may aggravate or make worse the problem intended to be solved and, in addition, may overload or even damage the grinding motors. In adjusting such pressures or forces, some prior art devices have employed multiple hydraulic piston-cylinder assemblies to counterbalance the gravitational forces inherent in the mass of the motor and grinding systems. But it is extremely difficult to balance and coordinate more than one piston-cylinder assembly per grinding stone so as not to tend to cock and lock the apparatus or otherwise jam it so that it is effectively immobilized or hung-up in a non-operative position. This interrupts the rail grinding operation, may cause damage to the apparatus and the track and surrounding area and may otherwise increase costs and reduce efficiency.

Moreover, such prior art systems are expensive and require considerable maintenance. They also lack the versatility provided by the apparatus of the present invention. In some instances, they lack adequate safeguards to protect the system in the event of malfunctions or other failures.

OBJECTS OF THE INVENTION

It is therefore a general object of the present invention to provide an improved rail grinding system which copes with the shortcomings associated with prior art systems. It is another general object to provide a rail grinding system which is versatile, low cost and relatively free of operating problems. It is another object to provide a rail grinding system having greater versatility and flexibility for adaptation to various grinding requirements.

It is a specific object to provide a rail grinding system which is readily adjustable to accommodate different rail spacings and requires only single adjustments to the rail grinding stone to approximate the running surface curvature desired. It is another specific object to provide a rail grinding system wherein the angle of curvature with which the stones contact the running surface is predetermined and not prone to operator error.

It is another specific object to provide a rail grinding system which is free of the problems inherent in systems employing dual or multiple hydraulic systems for adjusting the grinding stones. It is another specific object to provide a rail grinding system wherein the motor and grinding stone are self-aligning and less prone to jams. It is another specific object to provide a rail grinding system employing fewer hydraulic actuators and requiring less operator skill.

It is a further specific object to provide a rail grinding system designed to permit non-binding telescopic movement of the grinding motor and stone within the supporting housing and yet having a configuration to counteract the grinding torque. It is still another specific object to provide a rail grinding system which automatically protects itself in the event of grinding motor malfunction or failure.

These and other objects will become apparent from the description hereinafter set forth.

SUMMARY OF THE INVENTION

These objects are achieved by a rail grinding system which features a suspension system for the grinding stone which moves in a predetermined arc. The arc may be generally centered about the rail itself, e.g., the center of curvature of the running surface, or may be otherwise centered as dictated by functional or mechanical design considerations, as more fully set forth hereinafter. The suspension system also employs a single piston-cylinder arrangement aligned with the center of rotation of the grinding stone itself, thereby imparting a high degree of self-alignment to the apparatus.

In a specific embodiment, the rail grinding unit of the system comprises a carrier supported on the track and having a support frame extending over the track surface to be ground. In one embodiment, the carrier may be designed for releasable immobile mounting on a single rail while grinding a specific portion of the running surface, e.g., a welded joint. In another embodiment, the carrier may have a plurality of flanged wheels registering with both rails whereby the carrier may be propelled along the track for continous grinding thereof. In a particularly advantageous embodiment described in detail in connection with the drawings, there is a plurality of coupled carriers and water car pulled by propulsion means which also powers the rail grinding units.

In each embodiment there is a housing structure upstandingly supported on the support frame of each carrier in spaced relation from the track surface. The housing structure is adjustably movable on the support frame over a predetermined arc extending on each side of the vertical center line of the rail, e.g., 30° on each side thereof. This may be accomplished by the sliding engagement of support shoes on the housing structure with the bearing surface of curved segmental elements secured to the support frame. The curvature of the segmental elements corresponds to the desired curvature of the running surface, albeit at a different radius. In specific embodiments it has been found that a circular segmental curvature may be advantageously employed.

The movement of the housing structure may be continuous back and forth when, for example, a welded joint is being ground. Alternatively, the housing structure may be releasably locked in any desired position by hydraulic means, by bolts, or the like.

A motor, e.g., a dynamoelectric machine, is telescopically disposed and reciprocally movable within the housing structure. The motor has a rotatable shaft downwardly disposed toward the track with a grinding wheel mounted concentrically at the lower extremity thereof. The grinding wheel, which may have an annular configuration, is gravitationally biased toward the rail by the mass of the telescopically movable structure, particularly the motor.

The telescopic movement of the grinding wheel and motor within the housing structure is controlled by a single piston-cylinder assembly operatively secured to both the motor and housing structure so as to offset or counterbalance in whole or in part the gravitational forces. During the actual grinding operation, the piston-cylinder assembly offsets the gravitational forces in part, which is the modus operandi for controlling the force of the grinding stone on the running surface. During propulsion to or from the grinding site, or during other non-grinding operations, the piston-cylinder assembly more than offsets or counterbalances the gravitational forces and completely lifts the stone away from the running surface. The piston rod of the piston-cylinder assembly is in tension and is aligned with the center of rotation of the motor means and the grinding wheel. This has the substantial advantage of imparting self-alignment characteristics to the system.

BRIEF DESCRIPTION OF THE DRAWINGS

The present invention may be more clearly understood from the following detailed description of specific and preferred embodiments read in conjunction with the accompanying drawings wherein:

FIG. 3 is an overhead view of the grinding unit depicted in FIG. 2;

FIG. 4 is a partially-sectioned front plan view of the grinding unit depicted in FIG. 2 in the raised and locked position;

FIG. 5 is a partially-sectioned front plan view similar to FIG. 4 except that the grinding unit is shown in the lowered or grinding position and phantom lines are employed to depict the unit as it is positioned for grinding other portions of the running surface of the track;

FIG. 6 is a front plan view of another embodiment suitable for grinding individual welded rail joints and illustrating one of a number of means for continuously oscillating the rail grinding unit and grinding stone laterally relative to the running surface to be ground, i.e., an eccentrically-actuated rod; and FIG. 7 is a simplified schematic of the control system for one of the rail grinding units illustrating the protective measures taken in the event of motor failure or malfunction.

It should be understood that the drawings are not necessarily to scale and that certain aspects of the depicted embodiments may be illustrated by graphic symbols, diagrammatic representations and fragmentary and cutaway views for ease of understanding. In certain instances, mechanical details which are not necessary for an understanding of the present invention, or which render other details difficult to perceive, have been omitted or symbolically represented.

It should also be understood, of course, that the invention is not necessarily limited to the particular embodiments illustrated herein, although these particular embodiments depict the best mode presently contemplated for carrying out the invention.

DETAILED DESCRIPTION OF THE DRAWINGS

Figure 1:
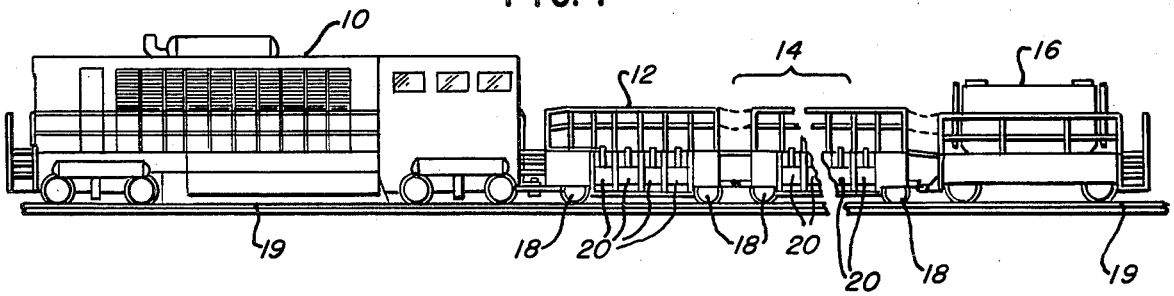
FIG. 1 is a schematic plan view of a preferred embodiment of the present invention including the propulsion and power unit, a plurality of grinding cars each having four individual grinding units on each side thereof and a water supply car, all coupled together.

Depicted in FIG. 1 is a forty-stone rail grinding system comprising self-propelled generator car 10, also referred to as the propulsion and power unit, which provides propulsion and power, e.g., electricity and compressed air, for five grinding cars having eight grinding stones each. The grinding cars are represented by car 12 and four additional identical grinding cars symbolically shown as fragmented car 14 for economy of drawing. Other embodiments may have more or fewer grinding cars, e.g., embodiments with two, three or four grinding units. Generator car 10 may be sized accordingly. Coupled to the trailing grinding car 14 is water car 16 which supplies the water sprays associated with each of the grinding units for suppressing dust and dousing sparks generated by the grinding units as the grinding operation proceeds. The water car may have a capacity, for example, of 4000 gallons. Optionally, water car 16 also supplies water sprays located adjacent the front and/or rear of the system and transverse the track so as to wet down the ties, suppress dust and extinguish any incipient fires. In a specific embodiment, this may take the form of a ten-foot wide spray bar mounted on water car 16 over and transverse track 19, so as to douse any sparks, fires or smoldering materials.

Each of the grinding cars is mounted on conventional flanged wheels 18 compatible with the track 19 whereby they may be readily propelled by generator car 10 to the grinding site at conventional speeds, e.g., forty to forty-five miles per hour. At the site the grinding stones are lowered and the cars are then slowly propelled along the track to be ground at approximately one to three miles per hour as the grinding operation proceeds. Generator car 10 also has sanitary and other crew facilities whereby the system may be self-sustaining and totally independent of other support facilities.

Each of the rail grinding cars 12 has four individual grinding units 20 on each side whereby, with five cars in series, a total of twenty grinding stones may simultaneously be brought into contact with the running surface of each rail to be ground. As those skilled in the art will recognize, a curved running surface may be satisfactorily approximated by a series of small chordal surfaces or facets. Accordingly, each of the stones is adjusted over the running surface at a slightly different disposition and angle whereby a plurality of chords or facets approximate the desired curvature, as more fully set forth hereinafter.

Referring to FIGS. 2–5, each of the rail grinding units 20 comprises a carrier 22 which is supported on track 19 by flanged wheels 18. The structural details of the carrier are not per se part of the present invention and may be of conventional design meeting requisite railroad use standards.

A support frame comprising transverse cross members 24 and 26 on carrier 22 extends over the running surface of track 19. Manifestly, the support frame may be an integral part of the carrier, whereby the same structural component or components serve both functions and are not separate and distinct structures. The support frame provides support for an open-ended box-like, four sided housing structure comprising side walls 28, 30, 32 and 34, upstanding side members 36 and 38 and fixedly secured to side walls 30 and 34, horizontal cross member 40 joining the upper extremities of side members 36 and 38, and support shoes 42 and 43 fixedly secured to the housing structure adjacent the lower extremity of side members 36 and 38, respectively. The lower surfaces of shoes 42 and 43 are curved and slidingly engage the matching curved bearing surface of segmental elements 44 and 46, which in turn are adjustably secured to cross members 24 and 26. As will become apparent, the curvature of the curved bearing surface of segmental elements 44 and 46 and the disposition of shoes 42 and 43 thereon determine the angle at which grinding stone 50 contacts the running surface of the rail.

Segmental elements 44 and 46 are transversely adjustable on support frames 24 and 26 by means of slots 52 in the support frames 24 and 26 and registering bolt slots 54 in the horizontal extremities of the segmental elements 44 and 46. Once the segmental elements are adjusted for the particular gauge or width or condition of the track, usually by centering them over the vertical center line of the rail section, they are releasably secured in place by tightening bolts 56.

In another embodiment, segmental elements 44 and 46 can be mounted at a preselected angle from the plane of the supporting surface of support frames 24 and 26 to compensate for various tie plate cant angles. For such purposes a spacer, shim, cam or other means can be introduced between the lower surfaces of the segmental elements and the supporting surface of frames 24 and 26. Alternatively, compensation for tie plate cant can be designed into the curvature of the bearing surfaces of the segmental elements.

One aspect of the versatility of the present invention is the fact that the curvature to be imparted to the track during the grinding can be changed or adjusted simply by changing the curvature of the bearing surface of segmental elements 44 and 46 and the corresponding curvature of shoes 42 and 43. In the embodiment shown, the curvature of segmental elements 44 and 46 corresponds to circular segments, although manifestly the curvature is not limited thereto. While the bearing surface of segmental elements 44 and 46 is depicted as a smooth surface suitable for sliding contact, in certain embodiments it could be corrugated, shoes 42 and 43 then having a registering corrugation or corrugations suitable for mating contact over the arc of curvature. Other alternatives will be apparent to those skilled in the art in the light of this disclosure.

In a preferred embodiment employing circular segmental elements 44 and 46, the center of curvature of the circular segmental elements 44 and 46 substantially coincides with the center of curvature of the running surface of the track. In still other embodiments, however, some departure from the theoretically-optimum circular curvature can be advantageously tolerated to achieve other objectives. For example, by locating the center of curvature of the segmental elements about two inches above the center of the running surface, rather than at the center of curvature of the running surface, which is, for example, ten inches below the running surface in the case of 132-pound rail, space requirements and the stroke of the piston of the hydraulic piston-cylinder assembly are advantageously minimized while still meeting minimum clearance requirements.

It should be recognized, however, that non-centered contact of the grinding stone and running surface may result in uneven reaction force components. By careful disposition and synchronization of the motors, however, the net forces may be directed in the direction of travel and could assist in propelling the system, as will be apparent to those skilled in the art.

In the embodiment of FIGS. 2–5, the housing structure is releasably secured to the curved bearing surface of segmental elements 44 and 46 by tightening bolts 60 and 62 (FIG. 3) which pass through centered apertures of shoes 42 and 43 and elongated slots 64 and 66 in the curved bearing surfaces of segmental elements 44 and 46, respectively. The angular disposition can be readily adjusted simply by loosening bolts 60 and 62, sliding the housing structure to whatever disposition is desired, and retightening the bolts. This is illustrated by phantom lines in FIG. 5, the angle being infinitely variable over the full angular range represented by the slots in the curved bearing surfaces of segmental elements 44 and 46, e.g., 30° on each side of vertical.

Telescopically disposed within the housing structure is the motor means or motor structure including motor 70, e.g., a ten-horsepower, 460-volt, three-phase, 60 hertz totally-enclosed fan cooled electric motor, which is designed to run at 3450 r.p.m. Electrical power from generator car 10 is supplied by electrical leads (not shown) connected at connector means 71 (FIG. 3). The motor structure also includes a supporting box structure at its lower extremity comprising apertured bottom plate 72 (FIGS. 3–5) to which motor 70 is bolted and side walls 74, 76, 78 and 80, which telescope within the larger open-ended box formed by side walls 28, 30, 32 and 34 of the housing structure. The rotatable shaft 82 (FIG. 4) of motor 70 passes through a centered circular aperture in bottom plate 72 of the inner box. Flange 84, which supports grinding stone 50, e.g., a six-inch I.D. by ten-inch O.D. resinoid bonded abrasive annular stone, is keyed and bolted to shaft 82 whereby the grinding stone is directly driven by motor 70 at its operating speed, e.g., 3450 r.p.m.

Sufficient clearance is provided for the inner box supporting motor 70 so that it can be freely raised and lowered within the housing structure. The non-binding telescopic movement of the inner box within the housing structure is facilitated by providing two elongated vertical brass wear strips on the outer surface of the vertical walls 74, 76, 78 and 80 of the inner box. These wear strips 86 are attached to walls 74, 76, 78 and 80 by recessed screws which permit wear strips 86 to be periodically replaced as they wear. With the wear strips in place, the total clearance between the wear strips and the inner surface of the outer box in either direction is approximately 1/16 inch. The essentially square design of the telescoping boxes advantageously resists the torque of the grinding motor and yet permits free telescopic axial movement of the motor 70 and stone 50 toward and away from the rail surface.

The motor structure also includes elongated support rods 88, 90, 92 and 94 which are double-bolted at the lower extremity to bottom plate 72 of the inner box and at the upper extremity to cross member 96, whereby the entire motor structure including motor 70, grinding stone 50, the inner box, the support rods 88, 90, 92 and 94, and cross member 96 reciprocally move as a unit. The extremities of cross member 96 are slotted so as to accommodate side members 36 and 38 whereby cross members 96 can move up and down with respect thereto. The left extremity of cross member 96, as viewed in FIG. 2, has an additional inner slot which accommodates guide bar 98 on side member 38.

Cross member 96 also supports pulley brackets 100 and 102 on which are mounted pulleys 104 and 106 for cables 108 and 110, respectively. One end of the cables is secured to tabs 112 and 114 on the upper edge of stationary wall 28 of the housing structure. The other ends of the cables are attached to tabs 116 and 118 on the upper support 120 of shield 122. The extremities of upper support 120 extend into the slots of vertical slotted guides 124 and 126 which are affixed to the outer surface of side wall 28, whereby shield 122 is free to move up and down for a distance corresponding to the length of the slots.

Shield 122 acts as a spark guard to deflect sparks produced by the grinding operation. In addition, it also serves as a protective shield should the grinding stone shatter and pieces thereof be propelled by centrifugal force outwardly. Shield 122, which features rounded lower corners, and slotted guides 124 and 126 are also designed so that should the shield 122 encounter an obstruction as the rail grinding unit is moved along the track, it will tend to ride over the obstruction by being raised and/or canted upwardly. The geometry of the pulley system is also designed so that as the motor structure is raised or lowered, shield 122 is automatically raised or lowered at twice the rate. For example, should the motor structure be lowered five inches within the housing structure, it lowers shield 122 ten inches. This assures that the lower portion of the shield is disposed below the plane of the grinding surface during the grinding operation.

Because of the substantial weight of the motor structure, it is gravitationally biased downwardly toward the rail head. The downward movement is limited by stop 130, which engages adjustable bolt 132 as the motor structure is lowered. Bolt 132 provides a convenient means of adjusting the lower limit of travel. Upward travel is limited by the engagement of cross member 96 with cross piece 40.

The motor structure may be locked in the uppermost position by inserting pin 134 in aperture 136 of the outward extending flanges of upstanding side member 38. Pin 134 thus prevents cross member 96 from moving downwardly and thereby effectively locks it in position.

To raise and lower the motor structure within the housing structure whereby grinding stone 50 may be brought into contact with the running surface to be ground, an in-line piston-cylinder assembly 140 is provided in upstanding relationship to motor 70. The center line of the piston-cylinder assembly is aligned with the center of rotation of the motor means and the grinding wheel. This feature imparts self-aligning characteristics and minimizes potential misalignment of the telescoping box components. It also minimizes the hydraulic cylinder effort to move grinding stone 50 axially away from the rail head.

Piston-cylinder assembly 140 is supported by being bolted to cross member 40 of the housing structure. The lower extremity of piston rod 142 is connected to cross member 96 so as to raise and lower the motor structure as the piston is raised or lowered within the cylinder. Hydraulic fluid is provided to the piston-cylinder assembly via flexible hose coupling 144.

In practice, the gravitational forces bringing grinding stone 50 in contact with the running surface to be ground substantially exceeds the desired force for proper grinding of the running surface and avoidance of overloading motor 70. The desired force is achieved by offsetting or counterbalancing a portion of the gravitational forces by means of the upward thrust of the piston and piston-cylinder assembly 140.

As those skilled in the art will recognize, piston rod 142 will be in tension and, because of the in-line arrangement, there is little danger of the motor means and grinding stone from becoming canted or cocked within the housing structure, as already set forth. This desired arrangement contrasts with prior art devices wherein, for example, two piston-cylinder assemblies are employed to counterbalance the gravitational forces, the piston rods being in compression, rather than tension. It is difficult to coordinate a plurality of piston-cylinder assemblies so that they move in unison and thus avoid cocking and locking the grinding assembly into an inoperative or misaligned position and potentially damaging disposition.

Angular adjustment of the housing structure by loosening and tightening bolts 60 and 62 automatically provides both the requisite lateral movement and the angular orientation of the working surface of the stone to achieve the desired surface contour. Thus, a single adjustment accomplishes the desired result, obviating multiple adjustments and the delays and errors inherent therein. The versatility of the present system is enhanced inasmuch as any desired predetermined lateral movement and angular orientation or series thereof can be achieved by employing segmental elements providing the same.

Because of fire hazards from sparks generated by the grinding operation, water spray jets are provided as a precaution. The water spray also serves the dual function of suppressing dust. In the embodiment of FIGS. 2–5, water manifold 150, which receives pressurized water via line 152 from water car 16, is mounted on side wall 28 of the housing structure and supplies downwardly-disposed water nozzle 154 and a complementary nozzle adjacent the other extremity of manifold 150, which is hidden behind shield 122 in FIG. 2.

Referring to FIG. 6, this embodiment is advantageously employed, for example, for smoothing or otherwise grinding joints of welded track. In FIG. 6, elements common to the embodiments of FIGS. 2–5 bear the same reference numeral. The rail grinding unit is stationarily disposed over the joint to be ground and is preferably locked to the rail during the grinding operation by, for example, conventional clamping means indicated by jaws 200 which are pivotally mounted (the mounting not being shown) and actuated by arms 202 (the actuating mechanism, e.g., an over-center cam, also not being shown). With support frame 203 thus firmly locked in place, the grinding stone 50 is then oscillated over the running surface of the joint to smooth the same.

The primary difference from the embodiments of FIG. 2–5 results from the fact that instead of the housing structure being bolted at a particular angle over the running surface, it is continuously oscillated during the grinding operation. This is accomplished by providing for sliding or rolling contact with respect to the segmental elements. One alternative is to loosen the locking bolts and permit the support shoes to slide smoothly over the curved surfaces of the segmental elements. In a preferred embodiment the locking bolts are eliminated and the supporting shoes replaced by roller bearings, e.g., upper roller bearings 204 and 206 and lower roller bearing 208, all of which are pivotally mounted on side wall 34. The upper and lower surfaces of the curved portion of segmental element 210 are designed for rolling contact with the roller bearings and to guide the housing structure as it oscillates. The angular position of the housing structure, and thus the area or line of contact of grinding wheel 50 with the running surface of rail 19 is continuously changed whereby the grinding wheel produces the desired curvature on the running surface.

Oscillation means is provided for the back and forth movement, and in FIG. 6 this takes the form of eccentric means 214 which is rotated about driven shaft 215. Actuating rod 216 is pivotally connected between eccentric means 214 and housing bracket 218 by means of pivot pins 220 and 222. As the eccentric means 214 turns, the housing structure, motor 70 and rotating stone 50, which is in contact with the running surface of rail 219, are oscillated about the center of rotation of segmental element 210.

Other means may also be provided for the desired oscillation. For example, a double-acting piston-cylinder assembly could be employed in place of eccentric means 214, the piston rod being linked to the housing whereby the oscillation is hydraulically, pneumatically or even manually controlled. Other means will be apparent to those skilled in the art in the light of the present disclosure.

Protective devices for the apparatus of the present invention are illustrated in the schematic of FIG. 7. While the protective system for only one rail grinding unit is illustrated for simplicity, it should be recognized that all units on a grinding car are similarly protected. In certain respects parallel piping is preferably used for ganging all units on each side of the car and thereby controlling all four units on a side together. In other respects, the protective device controls an individual grinding unit, particularly when the problem may be peculiar to a single unit.

Like apparatuses of the prior art, the present apparatus is provided with means to raise the stone and cut off the supply of extinguishing water when the forward speed of the system is reduced below a minimum, e.g., below about 0.7 miles per hour. Failure to do so could result in excessive metal removal and thereby create still further running surface problems.

In FIG. 7 high pressure air, e.g., 125 psig, is supplied to the system from source 300, e.g., a compressor and manifold in the generator car 10 of FIG. 1, the pressure being indicated by gauge 302. The air passes via pipe 304, manually-controlled valve 306 (which may control four units on one side of the car) and pipe 308 to air pressure regulator 310 where it is reduced to the desired operating pressure, e.g., 25 psig, as indicated by gauge 312, the desired operating pressure being determined by the amount of counterbalancing required for efficient grinding. The air then passes via pipe 314 to double-acting check valve 316.

In normal operation, the low pressure air is then transmitted via line 318, single check valve 320 and line 322 to the upper portion of oil reservoir 324. The oil in oil reservoir 324, under pressure from the air, then passes via pipe 326 to the counterbalancing piston-cylinder assembly which corresponds to piston-cylinder 140 of FIGS. 2–6. Although oil is used as the hydraulic fluid and is essentially non-compressible, it is cushioned by the compressible air in air-over-oil reservoir 324.

In preferred embodiments, efficient grinding is achieved by maximizing the rate of metal removal whereby the operation can proceed as rapidly as possible. To increase the rate of metal removal, grinding forces on the rail surface should be as great as possible consistent with the rating of the grinding motors. Accordingly, a technique for controlling the grinding operation is to observe the current flow to each grinding motor and adjust air pressure regulator 310 in FIG. 7 to achieve the full current rating consistent with continuous motor operation. Current meters and pressure regulators for all grinding units can be centrally located on a control panel of the generator car for monitoring and control by a single operator.

The aforementioned preferred embodiments lend themselves to automatic control. For example, air pressure regulator valve 310 can be automatically adjusted to increase air pressure and thus decrease the force of the grinding stone on the rail surface whenever electric current to motor 70 incipiently increases above a preset maximum. Similarly, air pressure regulator valve 310 can be automatically adjusted to decrease air pressure and thus increase the force of the grinding stone on the rail surface whenever electric current to motor 70 incipiently decreases below a preset minimum. The preset maximum and minimum may, of course, be the same. Such automatic control can be achieved by control means, e.g., a servo valve controlled by motor current, which are well within the skill of the art in the light of the present disclosure.

Should the speed of the system drop below the preset minimum grinding speed, e.g., 0.7 miles per hour, the low speed is detected by conventional normally-open low-speed switch 330 which senses the rate of rotation of one of the axles of the system. When low speed switch 330 closes, it connects 120 volts a.c. via lines 332 and 334 to actuate the solenoid of air valve 336. Prior to actuation, pipe 338 is connected to exhaust, i.e., 0 psig, via pipe 340. Upon actuation, high pressure air from source 300 is connected via pipes 342 and 344 to pipe 338 and thence via manual valve 306 and pipe 346 to the other side of double-check valve 316, thereby supplying high pressure air to oil reservoir 324. The high pressure air acting on the oil lifts the motor means and grinding stone to the uppermost position.

Figure 2:
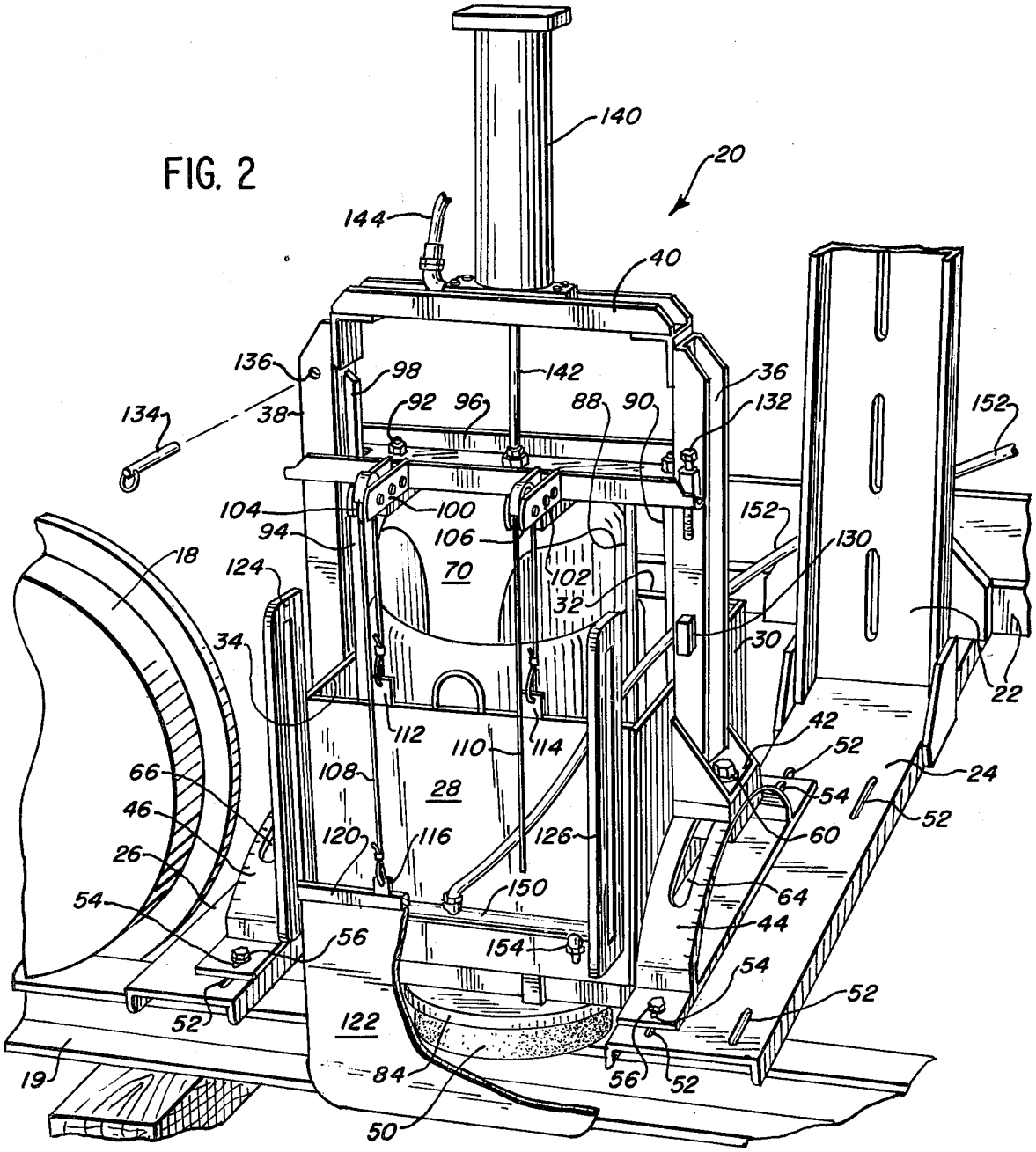
FIG. 2 is a perspective view showing details of one of the grinding units schematically depicted in FIG. 1 on a broken-away portion of one of the grinding cars, the grinding unit being shown in the lowered or grinding position.

Simultaneously, 120 volts a.c. are also supplied to the solenoid of normally-open water valve 350 so as to close the same. This results in water from source 352, e.g., water car 16 of FIG. 1, being cut off from manifold 150 and the water sprays 154 which are mounted adjacent spark guard 122 (FIG. 2).

In the case of obstructions on the track, an obstruction detector or sensor (not shown) may sound an audio or visual alarm or both to alert the operator to lift the motors by, for example, rotating valve 306 in FIG. 7. Alternatively or in addition, the detector or sensor may close normally-open microswitch 354. This would actuate the solenoids of valves 336 and 350, as already described, to raise the grinding units and shut off the water supply for a sufficient period for all the grinding units on that side of the car to clear the obstruction, at which point, they would again be lowered.

In still another more sophisticated embodiment, which avoids the necessity of having a detector for each grinding car of the system, the closing of the aforementioned microswitch 354 would also activate a linear measuring device. This would automatically activate at the proper point like solenoid valves in subsequent cars so that each would successively raise and lower the motors so that they successively clear the obstruction. Linear measuring devices are commercially available for such purposes from, for example, Veeder-Root Co., an affiliate of Western Pacific Industries, Inc.

In case of motor failure or malfunction, e.g., a broken winding causing motor stoppage or overheated winding causing motor burnout, it would be imperative to raise that particular grinding unit so that it will not be dragged along the track surface. This latter situation is coped with in the present control system by open-circuit and heat detectors associated with motor 70.

Such open-circuit detectors and overload or heat detectors, e.g., the Klixon detector, are commercially available and well known to those skilled in the art. When such detectors, which are schematically symbolized by the reference numeral 356 and signal 358 on FIG. 7, detect the malfunction, switch 360 is closed, connecting a source of voltage, e.g., 120 volts a.c., to the solenoid of normally-open air valve 362. This results in high pressure air from source 300 passing via pipes 342 and 344, valve 362, and pipe 364 to the upper end of oil reservoir 324, whereby the individual motor is raised.

As one skilled in the art will recognize, the systems for more than one motor can be connected into the illustrated system whereby manual control valve 306 may control all eight motors on a car or, separately, the four motors on one side of the car or the other. This is a matter of parallel piping and controls. In an advantageous embodiment, two manual valves such as 306 are employed so that the motors on one side of the car can be controlled separate and independent from the motors on the other side of the car. This is advantageous, for example, when grinding curved track wherein the outer track bears the greatest load and requires the most grinding attention. With separate controls for the units on each side of the grinding cars, the grinding treatment can be adjusted to meet the particular and differing needs associated with each rail. In the case of motor failure or malfunction, the circuit is individually connected to each motor so that only that motor need be taken out of operation should the overloaded condition occur in just that motor.

From the above description it is apparent that the objects of the present invention have been achieved. In addition to the advantages already set forth, the circular segmental elements 44 and 46 support the grinder motor 70 in such a manner that the plane of the annular working surface of the grinding stone 50 can be positioned at any desired angle from, for example, 0° to 30° as measured from a line tangent to the head radius of both rails of the track. Moreover, the design permits the grinding stone 50 to grind the rail head contour on both the gauge and field sides of the rail head as referenced from the vertical center line of the rail section. The position of the segmental elements 44 and 46 can also be adjusted to the right or to the left of the vertical center line of the rail section to compensate for variation in track gauge.

While the adjustment of grinding stone 50 is infinitely variable to any desired angle from, for example, 0° to 30° as measured from a tangent line to both rail heads, it has been found that a series of grinding stones adjusted to 0°, 2°, 6°, 20° and 30° as measured from the tangent line to both rail heads and grinding on both the gauge or field side of the vertical center line of the rail will grind narrow chordal surfaces (facets) that closely approximate the original rail head contour. The grinding stones, as well as the segmental elements, may also be adjusted angularly to compensate for various tie plate cant angles.

While only certain embodiments have been set forth, alternative embodiments and various modifications will be apparent from the above description to those skilled in the art. For example, while the angle of grinding is set in the embodiment of FIGS. 2–5 by bolting shoes 42 and 43 to the curved bearing surface of segmental elements 44 and 46, the angle could be set and held by hydraulic means, eccentric means or the like. Thus, in FIG. 6 the grinding motor and stone could be held stationary relative to segmental element 210 by stopping and locking eccentric means 214 at any desired position. These and other alternatives are considered equivalents and within the scope and spirit of the present invention.

Having described the invention, what is claimed is:

1. A rail grinding unit for grinding the running surface of a railroad track comprising:

(a) a support frame mounted on said railroad track and extending over the track surface to be ground;

(b) a housing structure upstandingly-supported on said support frame over, and in spaced relation from, the track surface to be ground, said housing structure being adjustably movable on said support frame transverse to said track over a predetermined arc generally centered about said track;

(c) motor means telescopically disposed and reciprocally movable with respect to said housing structure, said motor means having a rotatable shaft downwardly disposed toward said track;

(d) a grinding wheel mounted concentrically on said rotatable shaft and having a working surface disposed to contact the running surface of said track when said motor means is gravitationally advanced toward the same; and (e) a single piston-cylinder assembly controlling the reciprocal movement of said motor means with respect to said housing structure and the force with which the working surface of said grinding wheel contacts the running surface by counterbalancing gravitational forces, said single piston-cylinder assembly being disposed upwardly of said motor means and operatively affixed to said housing structure and said motor means with the center line of said piston-cylinder assembly aligned with the center of rotation of said motor means and said grinding wheel throughout the reciprocal movement of said motor means;

said grinding wheel thereby being movable throughout said predetermined arc and reciprocally movable relative to the surface to be ground whereby the working surface of said grinding wheel is contactable with any selected areas of the running surface to be ground.

2. The grinding unit of claim 1 wherein said housing structure is movably supported on said support frame by support means having curved bearing surfaces, the curvature of said bearing surfaces determining the angle at which the working surface of the grinding wheel contacts the running surface of the rail.

3. The rail grinding unit of claim 2 wherein said support means comprises:

(a) circular segmental elements on said support frame transverse to said track and having upwardly-disposed curved bearing surfaces; and (b) curved shoes on said housing structure supported on and registering with said circular segmental elements and slidable with respect thereto.

4. The grinding unit of claim 3 wherein said circular segmental elements are releasably bolted to said support frame through registering transversely-slotted bolt apertures so as to be adjustable in a direction transverse to said track.

5. A grinding unit of claim 2 wherein the curvature of said bearing surfaces is preselected so that when said housing structure is moved through at least a portion of said predetermined arc, the angles at which the grinding stone contacts the running surface approximates the desired running surface contour.

6. The rail grinding unit of claim 1 including means for oscillating said housing structure throughout said predetermined arc.

7. The rail grinding unit of claim 1 including means for releasably securing said housing structure at any selected point of said predetermined arc.

8. The rail grinding unit of claim 1 wherein the means for controlling the reciprocal movement of said motor means and the force with which said grinding wheel contacts the running surface to be ground comprises means for controlling the pressure of the fluid actuating said piston-cylinder assembly whereby to offset gravitational forces.

9. The rail grinding unit of claim 8, wherein said means for controlling pressure comprises a compressed air regulator, the compressed air regulated thereby acting on a hydraulic liquid reservoir for said piston-cylinder assembly.

10. The rail grinding unit of claim 8 including a source of hydraulic fluid having sufficient pressure to overcome all gravitational forces and lift said motor means and said grinding wheel upwardly in spaced relation from said track when said hydraulic fluid actuates said piston-cylinder assembly.

11. The rail grinding unit of claim 10 including valve means for connecting said source of hydraulic fluid to said piston-cylinder assembly responsive to means for detecting abnormal operation of said motor means.

12. The rail grinding unit of claim 11 wherein said means for detecting abnormal operation comprises a heat sensor.

13. The rail grinding unit of claim 11 wherein said motor means is electrically powered and said means for detecting abnormal operation comprises a current flow interruption detector.

14. The rail grinding unit of claim 1 wherein said support frame is mounted on both rails of said railroad track and having a plurality of said housing structures, motor means, grinding wheels and single piston-cylinder assemblies supported thereon over both rails whereby the running surfaces of both rails may be ground simultaneously.

15. The rail grinding unit of claim 14 wherein a plurality of said housing structures, motor means, grinding wheels and single piston-cylinder assemblies are supported in spaced relationship on each side of said support frame.

16. The rail grinding unit of claim 14 wherein said support frame is mounted on said railroad track by means of flanged wheels.

17. The rail grinding unit of claim 16 including propulsion means for moving the same along the track as the running surface is ground.

18. The rail grinding unit of claim 17 coupled to a plurality of said rail grinding units.

19. The rail grinding unit of claim 14 including control means for independently controlling the housing structures, motor means, grinding wheels and single piston-cylinder assemblies over each running surface.

20. A mobile rail grinding system for continuously grinding the running surfaces of a railroad track comprising in combination:

(a) propulsion and power means movably supported on said track for moving said system along said track and supplying power thereto;

(b) a plurality of coupled cars coupled to said propulsion and power means, each of said cars comprising a carrier supported by a plurality of flanged wheels engaging both rails of the railroad track, each of said carriers having a plurality of rail grinding units on each side of the carrier and disposed over both running surfaces of the railroad track, each rail grinding unit comprising:

1. a support frame mounted on said carrier and extending over the track surface to be ground;
2. a housing structure upstandingly supported on said support frame over, and in spaced relation from, the track surface to be ground, said housing structure being adjustably movable on said support frame transverse to said track over a predetermined arc generally centered about said track;
3. motor means telescopically disposed and reciprocally movable with respect to said housing structure, said motor means having a rotatable shaft downwardly disposed toward said track;

4. a grinding wheel mounted concentrically on said rotatable shaft and having a working surface disposed to contact the running surface of said track when said motor means is gravitationally advanced toward the same; and 5. a single piston-cylinder assembly controlling the reciprocal movement of said motor means with respect to said housing structure and the force with which the working surface of said grinding wheel contacts the running surface by offsetting gravitational forces, said single piston-cylinder assembly being disposed upwardly of said motor means and operatively affixed to said housing structure and said motor means with the center line of said piston-cylinder assembly aligned with the center of rotation of said motor means and said grinding wheel throughout the reciprocal movement of said motor means;

said grinding wheel thereby being movable throughout said predetermined arc and reciprocally movable relative to the surface to be ground whereby the working surface of said grinding wheel is contactable with any selected areas of the running surface to be ground.

21. The mobile rail grinding system of claim 20 wherein said housing structure is movably supported on said carrier by support means having curved bearing surfaces corresponding to said predetermined arc, the curvature of said bearing surfaces determining the angle at which the working surface of the grinding wheel contacts the running surface of the rail.

22. The mobile rail grinding system of claim 21 wherein said support means comprises:

(a) circular segmental elements on said carrier transverse to said track and having upwardly-disposed curved bearing surfaces; and (b) curved shoes on said housing structure supported on and registering with said circular segmental elementals and slidable with respect thereto.

23. The rail grinding system of claim 20 including:

(a) a source of hydraulic fluid having sufficient pressure to overcome all gravitational forces and lift said motor means and said grinding wheel upwardly in spaced relation from said track when said hydraulic fluid actuates said piston-cylinder assembly; and (b) valve means for connecting said source of hydraulic fluid to said piston-cylinder assembly responsive to means for detecting abnormal operation of said motor means.

24. The mobile rail grinding system of claim 20 wherein said propulsion and power means includes means for supplying power to said motor means.

25. The mobile rail grinding system of claim 20 wherein said motor means comprises an electric motor which is powered by electricity supplied from said propulsion and power means.

26. The mobile rail grinding system of claim 20 including water spray means disposed to douse sparks produced as the result of the grinding operation and a water car propelled by said propulsion and power means for supplying water to said water spray means.

* * * * *